US005119428A

United States Patent [19]

Prinssen

[11] Patent Number: 5,119,428

[45] Date of Patent: Jun. 2, 1992

[54] ELECTRO-ACOUSTIC SYSTEM

[75] Inventor: Willem C. J. M. Prinssen, St. Hubert, Netherlands

[73] Assignee: Prinssen en Bus Raadgevende Ingenieurs V.O.F., Netherlands

[21] Appl. No.: 489,184

[22] Filed: Mar. 8, 1990

[30] Foreign Application Priority Data

Mar. 9, 1989 [NL] Netherlands ..... 8900571

[51] Int. Cl.[5] ..... H04R 27/00

[52] U.S. Cl. ..... 381/83; 381/63

[58] Field of Search ..... 381/97, 63, 64, 83

[56] References Cited

U.S. PATENT DOCUMENTS

| | | | |
|---|---|---|---|
| 2,017,153 | 10/1935 | Kellogg | 381/64 |
| 3,535,453 | 10/1970 | Veneklasen | 381/64 |
| 3,796,832 | 3/1974 | Jaffe | 381/64 |
| 4,061,876 | 12/1977 | Jaffe | 381/63 |
| 4,361,727 | 11/1982 | Franssen et al. | 381/63 |
| 4,649,564 | 3/1987 | Barnett | 381/63 |

FOREIGN PATENT DOCUMENTS

| | | | |
|---|---|---|---|
| 0138267 | 10/1979 | Fed. Rep. of Germany | 381/63 |
| 8909465 | 10/1989 | World Int. Prop. O. . | |

OTHER PUBLICATIONS

D. de Vries et al., "Achtergronden Principes en Toepassingen van Het 'Acoustical Control System' (ACS)", NAG-pub. 92, 1988, pp. 53-64.

D. Kleis et al., "Een Eenvouding Multi-Kanaal Ambiofonie System", pub. lect. Eindhoven, Mar. 15, 1976, EHR60/3-004/76.

"MCR Remedie Tegen Te Droge Zalen", J. Podium & Technik, vol. 3, No. 6, Dec. 1981, pp. 14-15.

S. H. de Konig, "The MCR Sytem-Multiple-Channel Amplification of Reverberation", Philips Tech. Rev., vol. 1983/84, No. 41, pp. 12-23.

A. Krokstad, "Electroacoustic Means of Controlling Auditorium Acoustics", App. Acoustics, 0003-682X, 1988, pp. 275-288.

*Primary Examiner*—Forester W. Isen
*Assistant Examiner*—Sylvia Chen
*Attorney, Agent, or Firm*—Finnegan, Henderson, Farabow, Garrett & Dunner

[57] ABSTRACT

Electro-acoustic system for improving the acoustic of a predetermined room, said system comprising a microphone array having a plurality of microphones and a loudspeaker array having a plurality of loudspeakers, as well as a signal processing unit, interposed between said arrays, said signal processing unit having means for generating reflections, whereby at least one of the microphones is directed in such a manner that it receives at least reflected sound from a sound source in the predetermined room and/or that at least one of the loudspeakers is directed at a reflecting surface in the predetermined room.

29 Claims, 12 Drawing Sheets

ELECTRO-ACOUSTIC SYSTEM

BACKGROUND OF THE INVENTION

The invention relates to an electro-acoustic system for improving the acoustic of a predetermined room, said system comprising a microphone array having a plurality of microphones and a loudspeaker array having a plurality of loudspeakers, as well as a signal processing unit, interposed between said arrays, said signal processing unit having means for generating reflections.

Such an electro-acoustic system is known from the NAG-publication of the Nederlands Akoestisch Genootschap (Dutch Acoustic Society) No. 92, 1988, ACHTERGRONDEN, PRINCIPES EN TOEPASSINGEN VAN HET "ACOUSTICAL CONTROL SYSTEM" (ACS) (backgrounds, principles and applications of the "acoustical control system") by D. de Vries, D.Sc. and Prof. A. J. Berkhout, D.Sc., pp. 53–64 (also published in the journal of the Nederlands Elektronica en Radio Genootschap (Dutch Electronics and Radio Society) (1988)). This known electro-acoustic system will be called the ACS-system hereinafter. The ACS-system is installed in the auditorium of the Technische Universiteit (University of Technology) at Delft, The Netherlands, and in the Cultureel Centrum (Arts Centre) at Winterswijk, The Netherlands. Reference is also made to the journal Podium, Volume 6, Nos. 6 and 7, October and December 1988.

The ACS-system will be described in more detail hereinafter, referring in particular to FIGS. 4–6 and section 4 of page 59 of the above-mentioned NAG-publication. Instead of using acoustic feedback for producing reverberation, the ACS-system uses means for generating reflections, in particular a central processor. In principle, any desired reverberation time can be realized by the ACS-system, provided it is longer than that of the predetermined room. Said reverberation time is independent of the number of listeners in the predetermined room. In the ACS-system the aim is to keep the acoustic feedback as small as possible, in particular by firstly directing the microphones in such a manner that a great deal of direct sound and relatively little reflected sound is received from the sound source in the predetermined room; that is, in a room with a stage and an auditorium or an audience area, with a lot of microphones on or around the stage, whilst reflecting surfaces in the stage area are undesirable, whereby, in case the ACS-system is used in a theatre, it is advised to place the musicians between stage curtains of the stage and not to use any sound reflectors that may be present or a dismountable "orchestra shell", because this leads to interfering reflections. In the second place, acoustic feedback is reduced by using directional microphones. In the third place, acoustic feedback is minimized by directing the loudspeakers at the audience in the predetermined room. In the fourth place, acoustic feedback is reduced in the ACS-system by varying the time of the matrix-elements in the central processor.

Characteristic of the ACS-system is furthermore that a few dozens of microphones and loudspeakers are used on the stage and in the auditorium (the same number of microphones and loudspeakers in practice). The microphones above the stage are suspended low over the orchestra, i.e. about 4 meters. The usual number is 24–32 microphones with an equal number of loudspeakers. The acoustic parameters of the predetermined room itself are disregarded. The extent of the system is independent of the desired degree of improvement with respect to the existing acoustic. It is necessary to use microphones directed at the stage and loudspeakers directed at the audience in the auditorium (also called "acoustic holography"), because the realization of a complete acoustic according to predetermined specifications is aimed at. The loudspeakers are optimally directed at the audience by building them into the ceiling of the auditorium, as well as into wall parts of the auditorium, which are directed at the audience in such a manner that no reflections are produced. As a result it is often difficult to realize lateral reflections, because loudspeakers placed on the side of the audience may lead to reflections from opposite walls.

Because the area of the stage lacks reflections, supporting reflections and reverberation will often be produced on the stage by a subsystem, the so-called "stage reflection module", which consists of a plurality of microphones in the auditorium and a plurality of loudspeakers on the stage, about 12 of each in practice, in order that the musicians can hear themselves and each other. The microphones in the auditorium which form part of said stage reflection module are located at a relatively short distance from the loudspeakers of the so-called "auditorium reverberation module". The microphones above the stage forming part of said auditorium reverberation module are located at a relatively short distance from the loudspeakers of the stage reflection module. In this way the two subsystems are interconnected, in the form of a kind of loop, by acoustic coupling. The oscillation limits of the two modules are coupled, therefore.

The signal from each microphone of the auditorium reverberation module or stage reflection module is supplied, via the central processor added thereto, to each loudspeaker amplifier of the module in question (the loudspeaker amplifiers or the power amplifiers may be considered to be incorporated in the loudspeaker device or the signal processing unit). As a result a module has only one oscillation limit, which is determined by the most critical microphone-microphone amplifier-loudspeaker amplifier-loudspeaker chain (the microphone amplifier, or the preamplifier, may be considered to be incorporated in the microphone array or the signal processing unit), whereby also the total feedback between the joint loudspeakers and microphones plays a role.

A hum of voices and ventilation noise, for example, can be amplified by the microphones suspended in the auditorium, 12 in number for example.

It remains to be seen whether the system is suitable for the lyric theatre, because in that case the microphones must be suspended higher, in view of the fact that scenery must be provided.

Essential for the ACS-system is that it is aimed at to have the settings of the system sound the same in every auditorium; that is, that the individual character of the auditorium is not used. Reflections presented to the listeners by the system only emanate from signals produced by one or more central processors, which implies that a completely artificial acoustic is generated, without making use of the properties of the auditorium itself, that is, simulation of a desired acoustic is realized by the ACS-system.

The object of the invention is to provide an electro-acoustic system for improving the acoustic of a room in which music can be performed by extending the reverberation time and by enhancing the spaciousness of the sound while maintaining the acoustic properties of said room, i.e. improvement insofar as is necessary.

In order to accomplish that objective the invention provides an electro-acoustic system of the kind mentioned above, characterized in that at least one of the microphones is directed in such a manner that it receives at least reflected sound from a sound source in the predetermined room and/or that at least one of the loudspeakers is directed at a reflecting surface in the predetermined room.

Said measures imply the following possibilities, which possiblities all have the common feature, however, that besides the electronic generation of reflections or the enhancement of the reflection density by the signal processing unit, acoustic reflections are generated or the reflection density is increased by suitably directing the microphones and/or the loudspeakers in accordance with one or more of the following arrangements:

In the first place the microphones are directed for receiving direct sound and the loudspeakers directed at reflecting surfaces.

In the second place the microphones are directed for receiving direct sound and reflected sound and the loudspeakers are directed at reflecting surfaces.

In the third place the microphones are directed for receiving direct sound and reflected sound and the loudspeakers are directed at listeners.

In the fourth place the microphones are directed for receiving reflected sound and the loudspeakers are directed at reflecting surfaces.

In the fifth place the microphones are directed for receiving reflected sound and the loudspeakers are directed at listeners.

It is noted that directing at least one of the microphones in such a manner that it receives at least reflected sound from a sound source in the predetermined room is known per se from the published text of the lecture delivered by D. Kleis, M.Sc. for the Nederlands Akoestisch Genootschap (Dutch Acoustic Society) at Eindhoven on Mar. 17 , 1976, entitled: "Een eenvoudig multikanaal ambiofoniesysteem" (A simple multichannel ambionophony system) by Prof. J. J. Geluk, D.Sc., Radio Nederland Wereldomroep Hilversum, The Netherlands, D. Kleis, M.Sc., Philips Elektro-Akoestiek Breda, The Netherlands, EHR60/3-004/76, 15 March 1976. (See also the literature mentioned in said text). This electro-acoustic system, known by the name of "Multiple-Channel Reverberation System", will be called the MCR-system hereinafter. Said MCR-system is inter alia installed in the Philips Ontspannings Centrum at Eindhoven, the Netherlands (90 channels). Reference is also made to the journal Podium & Techniek, Volume 3, No. 6, December 1981, pp. 14–15 and the publication Philips Technical Review, Volume 1983/84, No. 41, pp. 12–23.

The MCR-system is based on the generation of reverberation by acoustic feedback between microphones and loudspeakers, however. In particular this known system consists of a plurality of identical channels. Each channel is a microphone-amplifier-loudspeaker combination. The amplification of a channel can be adjusted such that the sound reproduced by the loudspeaker falls on the microphone with sufficient signal intensity to be reamplified; i.e. acoustic feedback. In this manner each channel delivers a number of reflections which are delayed in time with respect to one another and which become weaker and weaker. When the acoustic feedback is enhanced there may be coloring by selective frequency-dependent decay. When the amplification is set even higher, with a closed-loop gain larger than 1, the system becomes unstable and oscillation occurs. Because the allowable amplification per channel is small, also the extension of the reverberation time per channel is small. Generally it is assumed that, dependent on the coloring that is considered allowable, 50–100 channels are required in order to double the reverberation time of the auditorium itself. Each microphone is located in the reverberant field of the loudspeaker belonging to the channel in question. In principle an equal number of microphones and loudspeakers is used, therefore. The microphones and loudspeakers are located at such a distance from a stage that the system only amplifies the reverberant field. The attainable reverberation time is dependent on that of the auditorium itself; it is namely multiplied with a certain factor in dependence on the number of channels.

The loudness of the auditorium is enhanced, because the sound level of the reverberant field is amplified. The hum of voices from the audience, the noise of the ventilation system and the like are amplified along with the other sounds, because all the sound present in the reverberant field is received.

The reverberation time is adjustable by selecting the amplification of the channels differently, by which the coloring and the sound level in the reverberant field are changed at the same time; they are coupled, therefore.

Another known electro-acoustic system which makes use of extension of reverberation time by acoustic feedback is the "Assisted Resonance System", called the AR-system hereinafter, supplied by Airo, Great Britain. The AR-system is inter alia installed in the Royal Festival Hall in London, England, and described in the article "Electro-Acoustic Means of Controlling Auditorium Acoustics" published in Applied Acoustics 0003-682x, 1988 and in the literature mentioned in said article. It is also a multi-channel system whereby, in contrast with the MCR-system, each channel is only active in a frequency bandwidth of 2–5 Hz, by placing each microphone in an acoustic (so-called Helmholtz) resonator. In this way the acoustic feedback in a channel may be high before instability occurs. As a result a single channel realizes a significant extension of the reverberation time in the narrow frequency band in question. In the Royal Festival Hall in London the system consists of 172 channels, always a single channel for a frequency band width of 2–5 Hz, and therewith influences the reverberation time in the frequency range between 58 and 700 Hz.

BRIEF DESCRIPTION OF THE DRAWINGS

The invention will be described in more detail hereinafter, with reference to the drawing, in which.

DESCRIPTION OF THE PREFERRED EMBODIMENTS

The electro-acoustic system according to the invention is intended to improve the acoustic of rooms in which music is performed. The reason was that many theatre auditoriums are acoustically unsuitable for musical events because of their short reverberation time and insufficient lateral reflections. These auditoriums are said to have dry acoustics. Architectural solutions are often not feasible and/or too costly in practice.

With the present system the reverberation time or the terminal reverberation (T60) and the running reverberation (EDT = early decay time) can be extended for each individual use of the auditorium and the spaciousness of the sound can be enhanced by introducing lateral reflections. Important is that the extension of the reverberation time is not an object by itself, but a means to obtain fullness of tone and a spacious sound image. The improvement of the acoustic is achieved while the acoustic properties of the auditorium are maintained. This means that the acoustic, characteristic of each individual auditorium, which already exist, are only improved with regard to the above-mentioned points insofar as is necessary.

Figure 1:
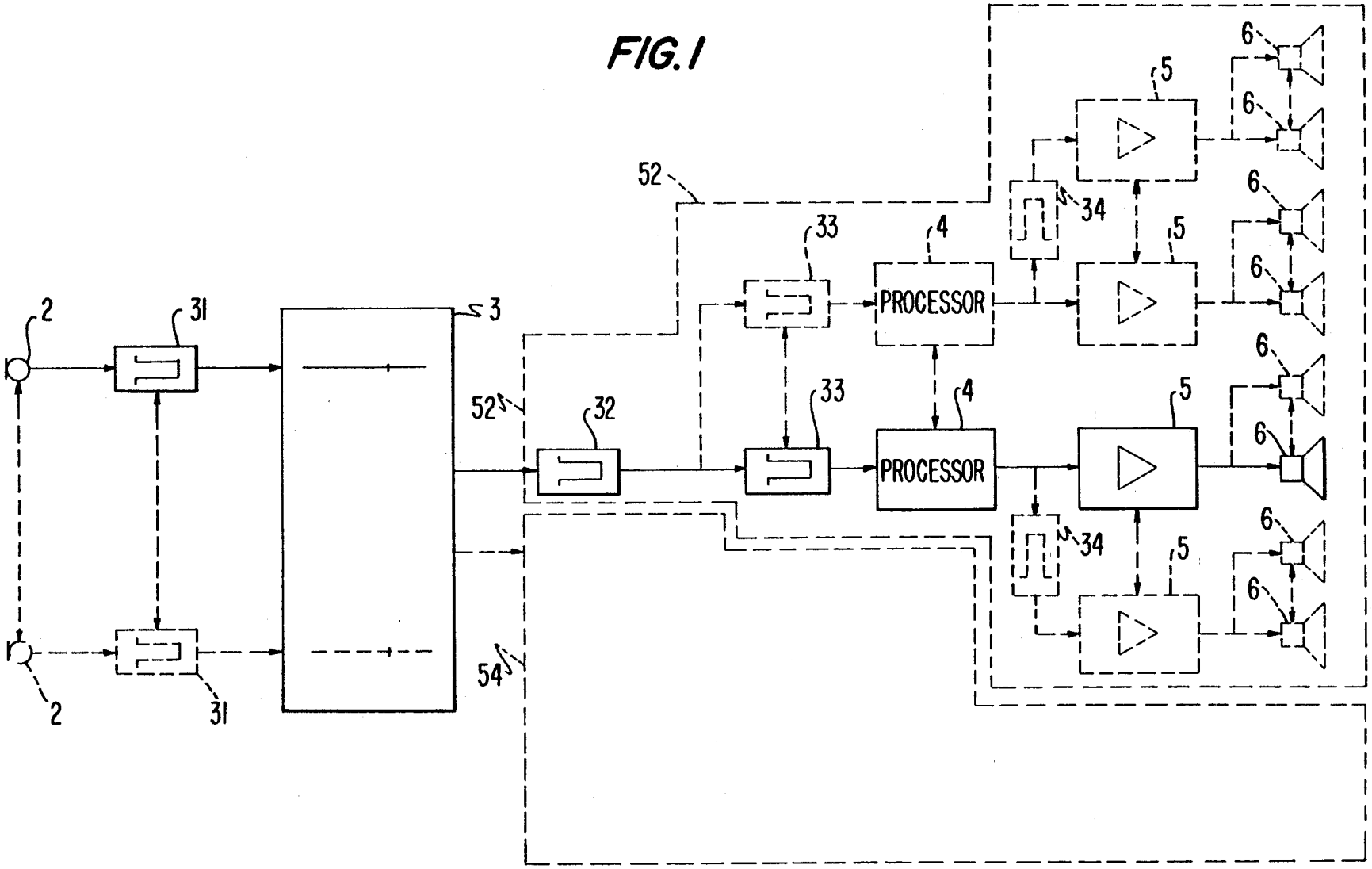
FIG. 1 is a general and simplified block diagram of a (sub)system according to the invention.

For the build-up of the system according to the invention reference is made to FIG. 1. The electro-acoustic system according to the invention, to be called the SIAP-system (System for Improved Acoustic Performance) hereinafter, comprises a plurality of microphones 2, whereby each microphone 2 may be provided with a preamplifier (not shown). The microphones are coupled to a mixing unit 3, by means of filters 31 if desired, for example implemented in the shape of equalizers. For the microphones 2 it is possible to use for example condenser microphones, inclusive of a preamplifier of the Schoeps (registered trademark) CMC 5 series, for example the CMC 5 MK41 s U or dynamic microphones of AKG (registered trademark), such as the D 224 or of Sennheiser (registered trademark) such as the MD 421 U or the MD 441 U. With dynamic microphones it is possible to use preamplifiers of e.g D&R (registered trademark). As a mixing unit 3 the Studer Revox (registered trademark) C-279 can be used. Microphones having a super cardiod polar pattern also can preferably be used.

At this moment it is emphasized that FIG. 1 shows only one subsystem with two channels 52, 54 and that furthermore only one channel is illustrated in detail. As far as the build-up is concerned the second channel 54 may correspond with the first channel 52. Now the illustrated channel will be discussed in more detail.

Each channel comprises the series circuit of a processor 4, an power amplifier 5 and a loudspeaker 6. The processor 4 may be connected with the mixing unit 3 by means of the equalizer 32 and/or the equalizer 33, if desired. As is indicated by means of a chain-dotted line in FIG. 1 a plurality of processors 4 may be provided, each of which may be connected with the equalizer 32 via an equalizer 33 or directly with the mixing unit 3. Each processor 4 may furthermore be connected with further power amplifiers 5, one or more equalizers 34 being interposed, whereby each power amplifier 5 may be connected with a plurality of loudspeakers 6. The equalizers 31, 32, 33 and 34 may be frequency spectrum equalizing filters of Technics (registered trademark) of type SH 8065. The processors 4 may be digital sound field processors of Yamaha (registered trademark), model DSP-3000, DSP-100 or DSP-1. The power amplifiers may be Quad (registered trademark) amplifiers 405, 520*f*, 606 or NAD (registered trademark) amplifier 2100 PE. The loudspeakers may be full range loudspeakers such as Kef (registered trademark) loudspeakers, for example models CR200/CR250SW, C35, C55, C75, C95 or RR104.

Generally said the SIAP-system comprises a microphone array with a plurality of microphones 2 and a loudspeaker array with a plurality of loudspeakers 6, as well as a signal processing unit, connected between said arrays, with processors 4 for generating reflections. The equalizers 31–34, the mixing unit 3 and the power amplifiers 5 may be considered to be incorporated in the signal processing unit.

A subsystem will often consist of two microphones 2 with preamplifiers, one equalizer 32, 33 or 34, one processor 4, two power amplifiers 5 and two loudspeakers 6. A complete system may consist of ten subsystems with a control panel (not shown) for setting selection; for example, four settings can be provided.

All parts of the SIAP-system are permanently located at a determined position. The operation of the SIAP-system is based on attuned positions and directions of microphones 2 and loudspeakers 6 in combination with the acoustic parameters to be set into the processors 4 and the tuning of amplifications in the system. In particular the location and the direction of the microphones 2 with respect to the sound source (not shown) (musicians on the stage or in the orchestra pit) determine the strength of the direct sound received by the microphones 2, as well as the number and the intensity of the reflections received by the microphones 2. The location and the direction of the loudspeakers 6 with respect to the listeners (not shown) (the audience in the auditorium and the musicians on the stage or in the orchestra pit) determine whether the sound from the loudspeakers 6 reaches the listeners entirely or substantially directly, or entirely or partly indirectly through reflection via surfaces in the room (hall walls and ceiling). The amplifications in the system determine the degree to which the sound received by each of the microphones 2, processed by the processors 4 and reproduced by the loudspeakers 6, contributes towards the sound.

The microphones 2 are usually mounted above the stage, at the side of the auditorium, at a relatively large distance from the sound source, in such a manner that they cover the entire performance area, inclusive of the orchestra pit (lyric theatre performances). As a result they do not form a hindrance to the use of the technical stage facilities. The location of the microphones 2 and the loudspeakers 6 is determined once-only, whereby use is made of measurements and/or computations. The microphones 2 and the loudspeakers 6 are permanently located at their determined places, because this is essential for the operation of the system. The loudspeakers 6 will be provided primarily in the top of the auditorium and near the side walls, because use is made, where possible, of the reflecting, i.e. acoustically hard surfaces. Moreover, with loudspeakers 6 placed at the side of the audience, the sound emanating from the loudspeakers 6 is lateral. With the exception of the microphones 2 and the loudspeakers 6 no equipment of the SIAP-system needs to be placed in the auditorium.

Before discussing the operation of the SIAP-system in more detail we shall first discuss its acoustic basis.

For good musical acoustic the reverberation time is of major importance. It must be within certain limits for every use. For chamber music the desired reverberation time is longer than for speech, but clearly shorter than for symphonic music, in particular 0.8–1.2 seconds for speech, 1.2–1.5 seconds for chamber music and 1.7–2.3 seconds for symphonic music. Comparable differences exist with regard to the running reverberation and the lateral reflections. Reverberation is a means for obtaining a fullness of tone as a result of the phenomenon that because of the time which is required for each signal to decay, the notes of the music are interconnected. In order to be able to perceive this, the sound level of the reverberation must be sufficiently high with respect to the direct sound. Moreover, it is necessary for the reverberation to be built up of a large number of individually relatively weak reflections, which together make the sound fade away or decay in the room. Lateral reflections promote the spaciousness of the sound. The aggregate of direct sound, early and late reflections, frontal and lateral reflections, reverberation time and running reverberation are, in their mutual relations, the most important factors which together constitute the acoustic of a room. The early reflections are only slightly weaker than the direct sound and few in number. With an increasing delay time the reflections become larger in number and weaker. The beginning of the reverberation tail is about 200–300 ms after the direct sound. The quality of the reverberation depends on the number of reflections of which it is built up, i.e. the reflection density. The spaciousness of the sound generated by the lateral reflections causes the phenomenon which is called the "singing along" of the auditorium. For this it is necessary that there are many reflections from many directions, and especially from the side, whereby each of these reflections should not be so strong as to be heard individually.

The point of departure with the design of the system is therefore that a great reflection density must be realized because otherwise a good and naturally sounding result is not possible. As already said before the SIAP-system does not make use of extension of reverberation time by acoustic feedback between microphones 2 and loudspeakers 6. The reflections are electronically generated by the processors 4. It is also possible, however, to receive the sound, reproduce it in a room with a certain reverberation, pick up said sound provided with reverberation and render it in an auditorium. The most practical choice is to use the digital delaying equipment, which is available at present, such as sound field processors, in view of the reflection density to be realized and the setting possibilities of the acoustic parameters.

If only direct sound is offered to the processor 4, exactly the reflection pattern generated in the processor 4 appears at the output of the processor 4. By directing this sound at the listeners only this completely artificially generated acoustic determines the sound. In rooms having a short reverberation the reflections of the room itself are sufficiently weak, so that the above-mentioned artificial acoustic dominates in these rooms. This means that the various rooms will still sound the same in principle, without their own acoustical character, therefore.

As already explained before, a well-sounding reverberation is only possible with a great reflection density. In practice it has become apparent that a reasonably great density is possible with processors. Instead of these it is also possible to use analogous delaying equipment, such as reverberation springs or plates, with the characteristic disadvantage of coloring of the sound, however. According to the invention the quality of the reverberation can be improved by not only using the direct sound as an input signal for the processor 4, but in particular also reflections.

Figure 2A:
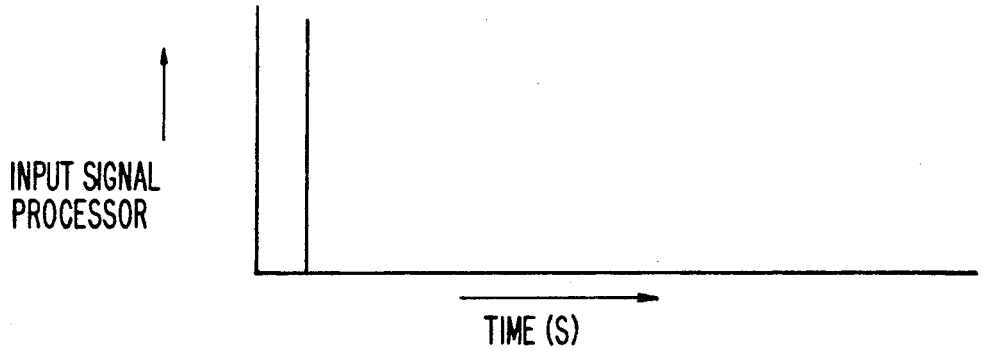
FIGS. 2*a*–2*d* are graphical drawings illustrating the densification of the reflection pattern at the output of a processor of the (sub)system of FIG. 1, when picked up by a respective microphone of the (sub)system of FIG. 1 of direct sound only (2*a*, 2*d*) and direct sound in combination with reflected sound (1*c*, 2*d*) respectively.
Figure 2B:
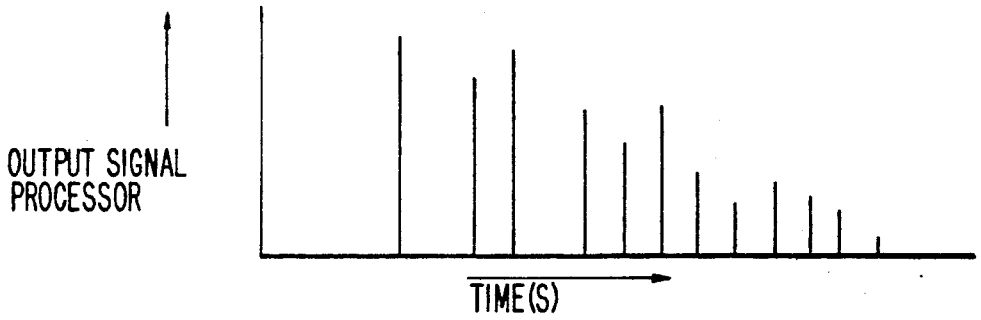
Figure 2C:
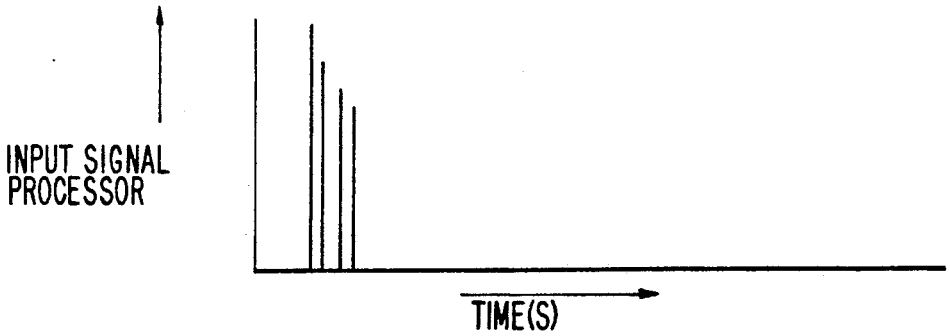
Figure 2D:
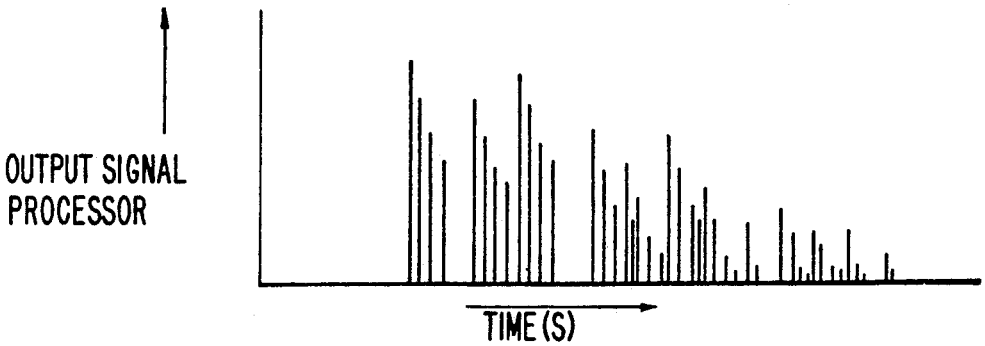

FIG. 2*a* shows the input signal in time from a processor 4 when a respective microphone 2 only picks up direct sound, and FIG. 2*b* shows the corresponding output signal in time from said processor 4. FIGS. 2*c* and 2*d* respectively correspond with FIGS. 2*a* and 2*b*, but now with direct sound and three reflections being picked up by a respective microphone. As is shown the reflection density is magnified four times with direct sound with three reflections. If the sound which is picked up already has some reverberation, the quality of the output signal becomes noticeably better. Because the reflection pattern of the sound which is picked up will be (slightly) different in every auditorium, the output signal already has its own distinct character.

By delivering the sound reproduced via the loudspeakers 6 to the listeners not only directly, but also or only by means of reflection from the walls or the ceiling, there is not (only) the sound signal emanating from a loudspeaker 6, but the sound from a loudspeaker 6 also reaches the listener in the form of a number of reflections, in particular when sound diffusers are incorporated in the wall or in the ceiling. Also in this manner the reflection density is increased. When the reflection density in the reverberation tail is great enough for the reverberation to sound perfectly naturally, further densification has no further audible results. On the other hand there are no disadvantages attached to this.

By placing the loudspeakers 6 in accordance with the present invention the ratio of frontal to lateral energy, and as a result the spaciousness of the sound, can furthermore be influenced. By using several processors 4 a certain reflection pattern can be reproduced for each loudspeaker 6 or group of loudspeakers 6. In this manner the spaciousness can further be influenced and the reflection density moreover (further) increases. Put differently, by using several subsystems in accordance with FIG. 1 the reflection density may further increase and the tuning possiblities are increased. If desired a mixing unit 3 can be used for each subsystem. The use of the SIAP-system leads to an acoustic result which is a combination of the acoustic in the auditorium and the addition by the system itself. Different auditoriums will still sound differently and have their own distinct acoustic character, therefore.

Hereinafter the picking up of the sound will be pursued in greater depth.

The sound produced on a stage and in an orchestra pit, if present, is received by a plurality of microphones 2. The selection of the number of microphones 2 and the desired polar pattern in particular depends on the one hand on the area of the stage and on the other hand on the risk of the system becoming unstable by acoustic feedback. Each subsystem has its own oscillation limit, as a result of which it is possible to effectively prevent said oscillation by tuning the system and directing the loudspeakers 6. The microphones 2 are located at such a distance from the sound source, that in particular the reflected sound present at that location is received, besides the direct sound. Because it is intended to receive as much reflected sound as possible, a relatively large microphone distance is used, so that the reflected sound is relatively strong with respect to the direct sound. Sound reflecting surfaces in the neighbourhoud of the sound source, such as an orchestra shell on the stage or an orchestra pit, or singers on the stage, play an important role in the realization of a natural sound. The distance between the microphones 2 and the sound sources is mostly 5–10 m with this system, but larger distances may occur. The microphones are therefore as much as possible located in the reverberant field or the diffuse sound field and are directed at the stage and/or at reflecting surfaces in the stage area. Specifically, one or more microphones can be located in the diffuse sound field of the audience area and directed at the stage and/or reflecting surfaces in the stage area. However, one or more microphones can be alternatively located in the diffuse sound field of the stage area and directed at the audience area and/or at reflecting surfaces in the audience area.

Acoustic feedback is allowed, provided it is sufficiently low in order to prevent coloring of the sound. For this purpose sound-absorbing and/or shielding material is provided in the direct vicinity of the microphones 2, if necessary.

In auditoriums where the acoustic coupling between the auditorium and the stage is not quite so good it may be decided to select one or more subsystems for the benefit of the stage.

If necessary the total number of microphones 2 may amount to 40.

Now the matter of the signal processing will be pursed. Preferably each microphone 2 delivers a preamplified signal to the mixing unit 3. With a view to further treating the signals picked up from every point of the stage in a correct mutual strength ratio (balance) the amplification and the frequency characteristic of each microphone input of the control panel 3 is adjusted. In the mixing unit 3 the input signals are assembled into single-channel or two-channel output signals. When the preamplified microphone signal can be presented to the processor untreated the mixing unit 3 is left out.

Filters 31–34 may be incorporated in the system in order to be able to control the signal intensity in certain frequency bands. It is possible to use 1/1 octave band, ⅓ octave band and narrow band filters. Said filters can be incorporated in the system at various places, according to what is desired. FIG. 1 illustrates a few possibilities. This implies that in certain cases it is not necessary to use filters 31–34, whilst it may also occur that all filters shown in FIG. 1 are necessary. Besides these extremes several variants are possible. The function of the filters 31–34 may be to limit acoustic feedback where this is considered desirable for the stability of the system or for preventing coloring of the sound. Another application may be that the sound field in a room does not have to be influenced, or must be influenced to a smaller degree in certain frequency bands than the remaining audio spectrum. For the equalization of the frequency characteristic use is made of equalizers as a possible implementation of the filters 31–34.

When several processors 4 are used for each subsystem said processors 4 are each fed by the same single-channel output signal from the mixing unit 3, but the microphone signals may also be distributed over two channels, whereby for each processor 4 one of said channels serves as an input signal.

With the processors 4 now used the following acoustic parameters can be set: The delay time of the first reflection to be generated (between said first reflection and the beginning of the reverberation for example 300 ms, dependent on the processor used, a number of reflections with an increasing delay time, a decreasing sound level and a greater reflection density is generated), the reverberation time, the sound level of the beginning of the reverberation with respect to the level of the first reflection, the ratio of the reverberation time with high frequencies with respect to the other frequencies, 500 Hz and lower, the frequency range of the sound signal to be processed and the sound level of the processed signal with respect to the input signal.

When the input signal already contains reflections which are delayed in time with respect to one another, the density of the reflections in the output signal from the processor 4 is greater than the number of time-delayed signals generated in the processor 4 itself. As a result a greater reflection density is created. In combination with the reverberant field of the auditorium itself the reflection density may increase even further. The object of this is to obtain a naturally sounding reflection pattern, both with regard to the early reflections and with regard to the decay of the reverberation, the so-called reverberation tail. In order to achieve a greater reflection density a number of processors 4 may be connected in series (not shown).

When the area around the microphones 2 and/or the loudspeakers 6 already contains some reverberation, there is a possibility that the reverberation time set in the processors 4 can be considerably shorter than the value to be realized together with the auditorium.

The above acoustic parameters, set in the processors 4, are called the setting. For different uses separate settings can be used. Dependent on the use, the desired setting is selected by means of a control panel (not shown). The acoustic parameters to be set in the processors 4 and the tuning of the system are determined for every auditorium individually. By means of measurements and/or computations it is determined what addition by the system to the existing acoustic is desired. For a new auditorium only computations are made. The results of this examination lead to the determination of the values to be input in the system and of the remaining tuning of the equipment. The number of processors 4 which is used in a system depends on the acoustic situation of the auditorium to be improved. Experience gained with experimental set ups of the SIAP-system has shown that in most theatre auditoriums, which must be made suitable for concerts and lyric theatre performances such as operas, operettas, musicals, ballet and revues, about 10 subsystems are required, in particular for the auditorium, and likewise 10 subsystems can be used for the benefit of the stage in case the acoustic coupling between the auditorium and the stage is not quite so good.

The output signal from a processor 4 is supplied to at least one power amplifier channel which provides at least one loudspeaker 6 or a plurality of loudspeakers 6 with a signal. The output signal from a processor 4 may also be supplied to several power amplifiers 5. For each power amplifier 5 several individual loudspeakers 6 or separate units of a number of loudspeakers 6 may be used. A loudspeaker 6 can be fed with the signal from several amplifiers 5. It is always decided for each auditorium individually what configuration or coupling is used.

The microphones 2 are located at such a distance from the sound source in the SIAP-system that a large area can be covered by a single microphone 2 and relatively many reflections are already picked up. This means that the entire stage is covered by one to four microphones 2. In most cases the microphones 2 will moreover be located beyond the critical distance, so that the reflections, in which all sound sources, such as instruments and singers, are represented, are at least as strong as the direct sound and are often even dominant. In that case a single microphone 2 receives the entire sound.

By building up the system of a plurality of subsystems each having at least one microphone 2, one processor 4, one amplifier 5 and one loudspeaker 6, and not interconnecting said subsystems, each subsystem has its own oscillation limit. Usually the aim will be with the entire system that the initial loudness of the reverberation of the auditorium and the system together is equal to or slightly lower than the initial loudness of the reverberation of the auditorium itself. The oscillation limit can be influenced by suitably selecting the location of microphones 2 and loudspeakers 6, for example shielded from each other, and their polar pattern. The difference between the attainable initial loudness of the reverberation and the desired value determines the number of subsystems required. It can be computed that in an average auditorium, when using microphones having a cardiod polar pattern and equalization of the frequency spectrum ten to twenty subsystems are sufficient for obtaining the same reverberation level as that of the auditorium itself; the exact number depends on the acoustic feedback between the loudspeakers and the microphones in the room in question. As long as the number of subsystems is smaller than about 50 they hardly influency each other at all by mutual acoustic feedback.

Now the matter of the reproduction of the reflections generated will be pursued. The reflections and the reverberation generated by the system are reproduced by loudspeakers 6 in the auditorium and/or at the location of the stage, whereby for each auditorium or part of the auditorium a selection is made from one or more of the following possibilities or combinations thereof.

Figure 3:
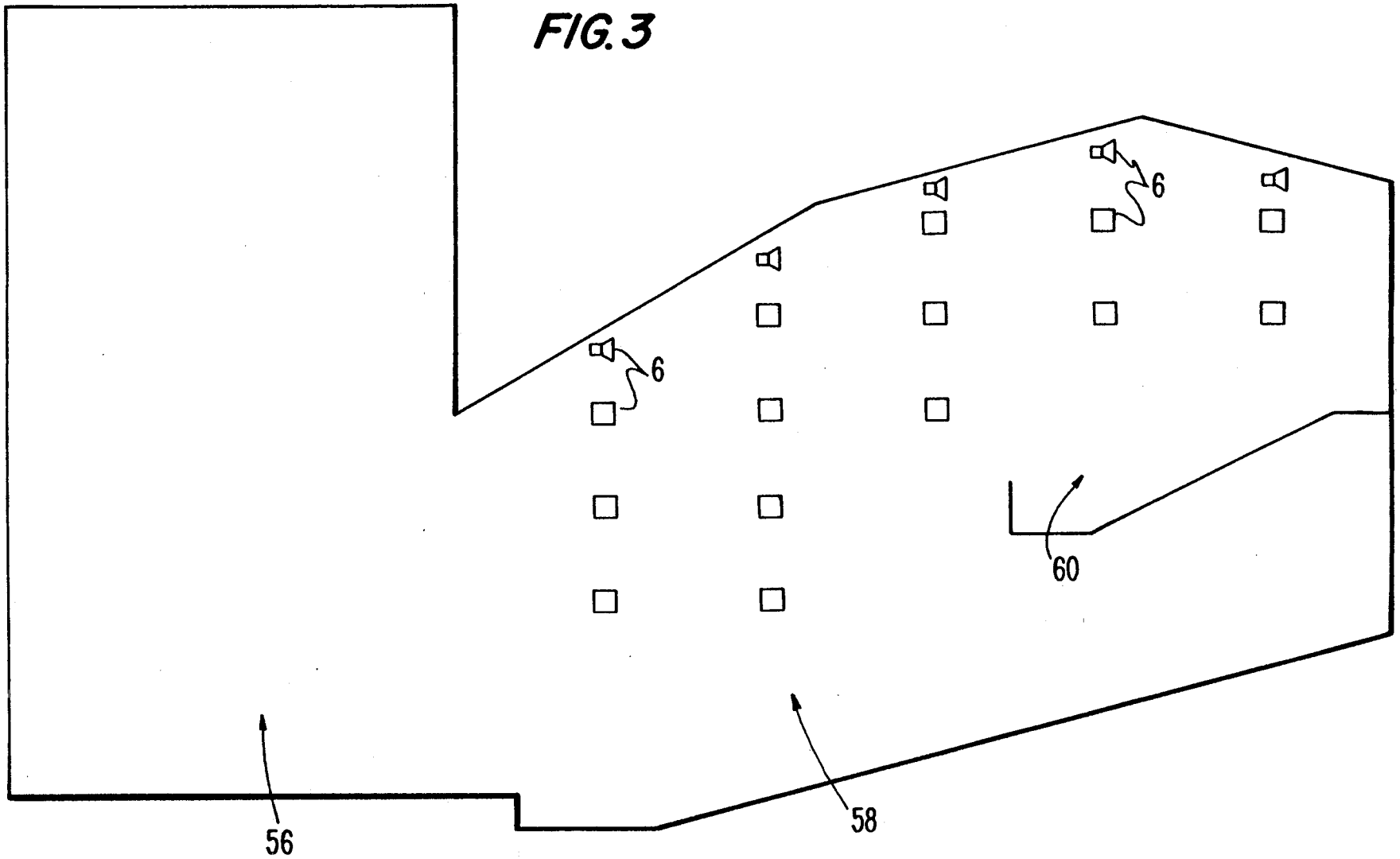
FIGS. 3–6 show the location according to the invention of the loudspeakers of the (sub)system of FIG. 1 in an auditorium.

The location of the loudspeakers 6 is in the top of the auditorium or evenly distributed over the auditorium, and their direction is usually such that, together with the reverberant field of the auditorium itself a naturally sounding reverberant field is created. An example of this is illustrated in FIG. 3 showing loudspeakers 6, stage area 56, auditorium (audience) area 58, and balcony 60.

Figure 4:
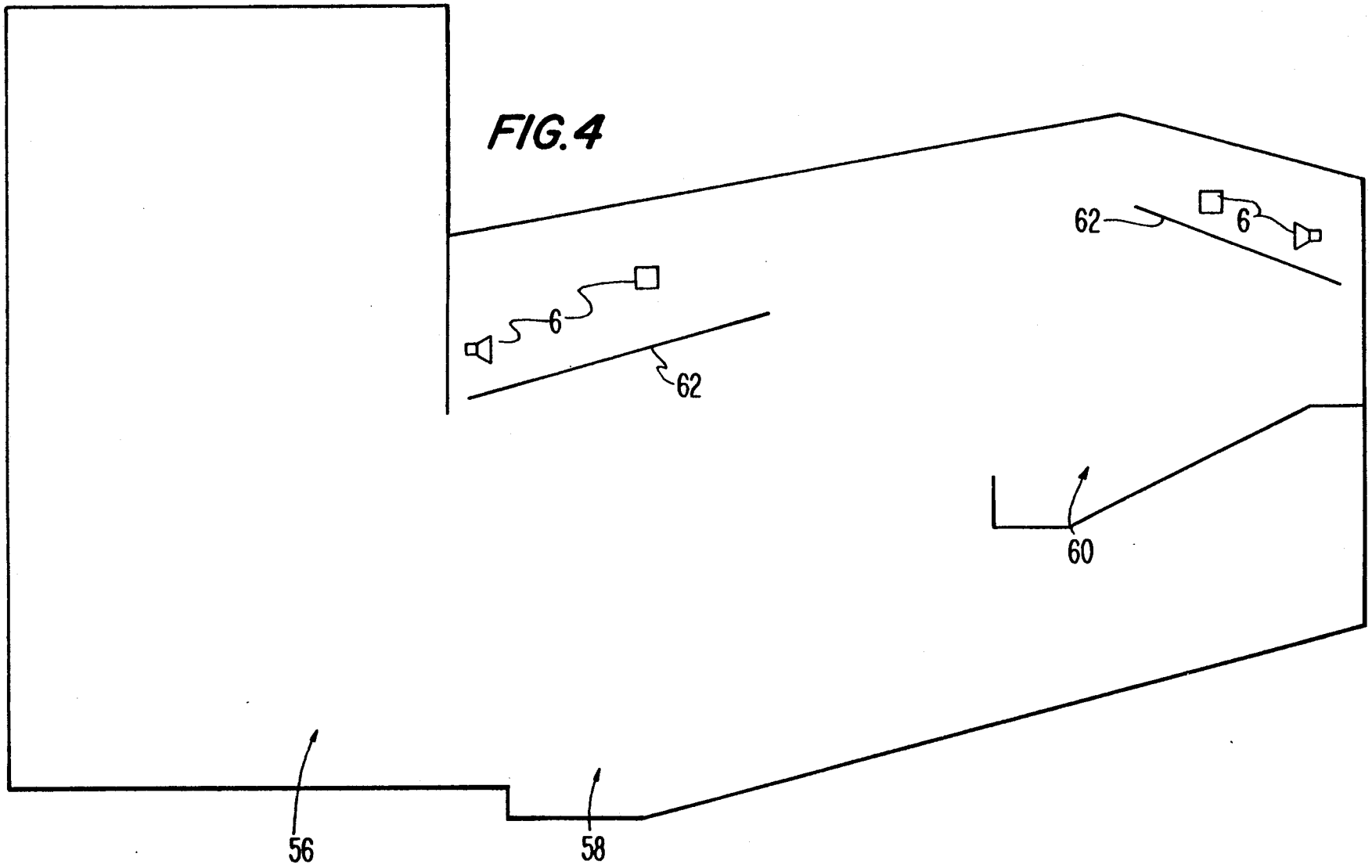

The loudspeakers 6 can be placed above sound reflectors present in the auditorium or yet to be provided, in such a manner that the reproduced reflections and the reverberation, mixed with those of the auditorium, reach the audience and the stage. Compare FIG. 4 showing loudspeakers 6 placed above spaced apart overhead sound reflectors 62.

Figure 5:
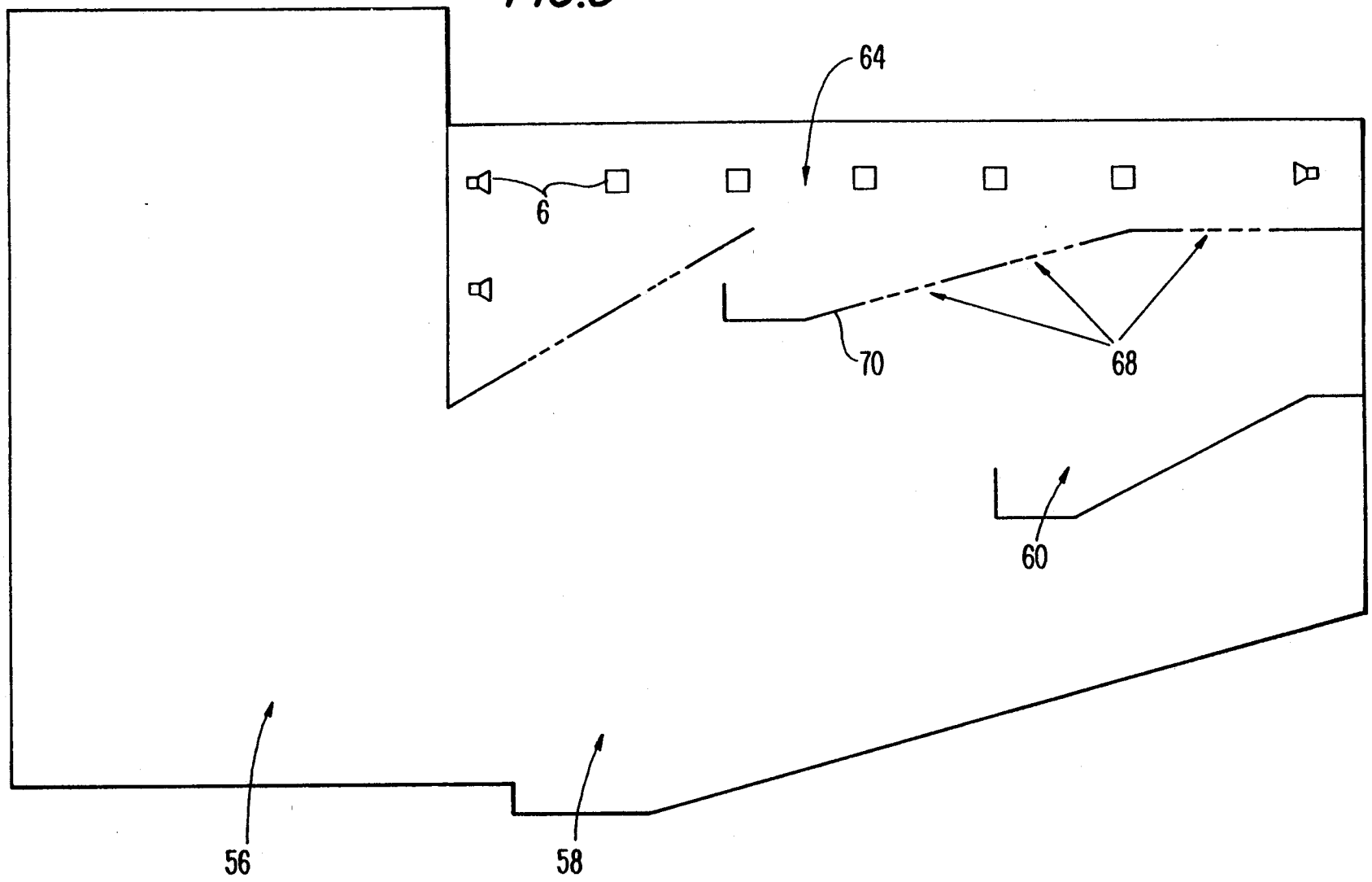

The loudspeakers can be placed in the room, for example the attic, above the auditorium, where the sound is mixed with the reverberation present at that location and reaches the audience and the stage through openings in the ceiling, usually via the reverberant field of the auditorium in practice. The openings in the ceiling mostly concern lighting galleries and catwalks, ventilation systems and/or have been provided for a system for a variable acoustic. An example is illustrated in FIG. 5 showing loudspeakers 6 in overhead secondary room 64 having openings 68 in ceiling 70.

Figure 6:
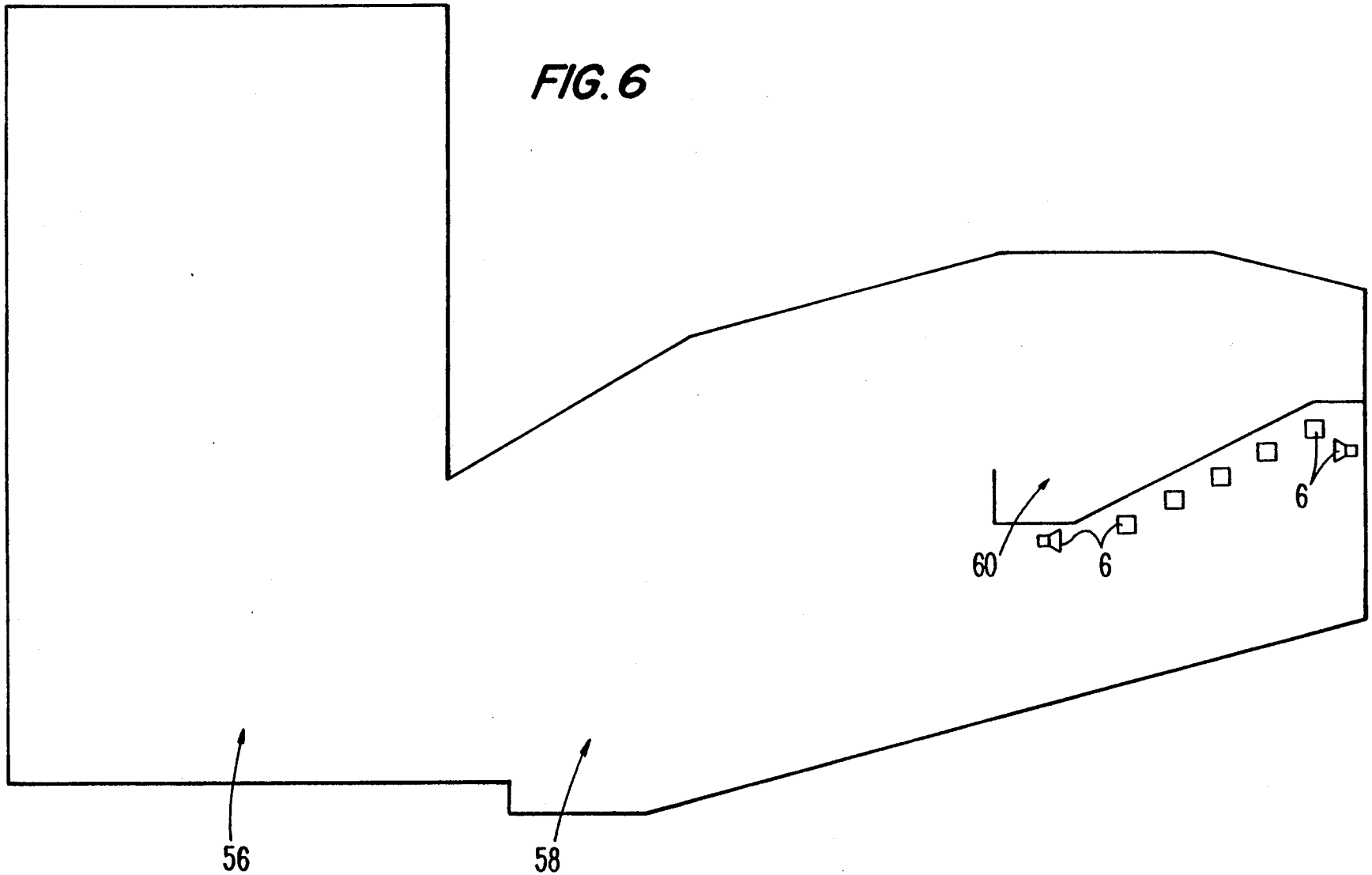
Figure 7A:
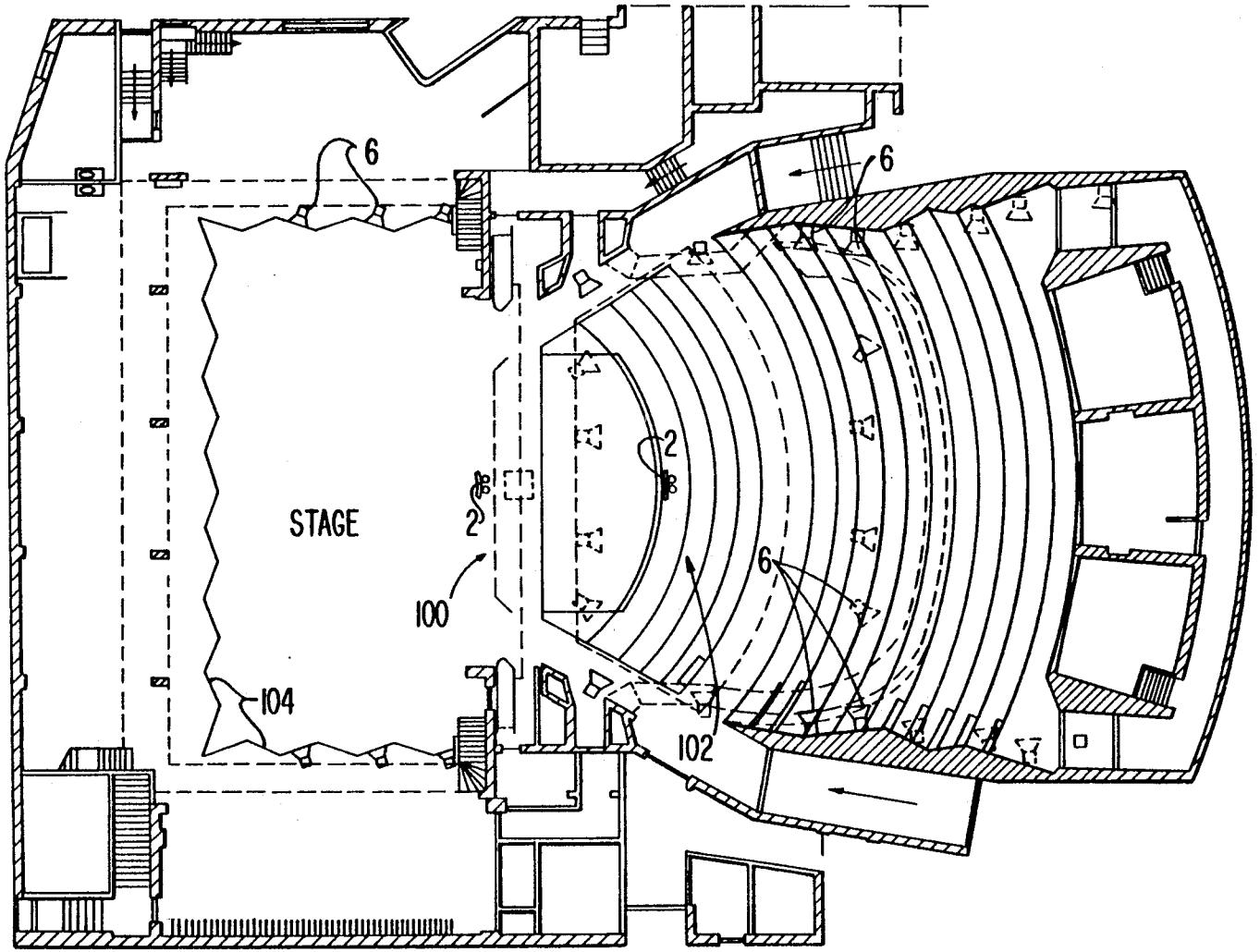
FIGS. 7*a*, *b*; 8*a*, *b* and 9*a*, *b* show a characteristic array of the microphones and the loudspeakers according to the SIAP-system, the ACS-system and the MCR-system respectively in an existing theatre auditorium.
Figure 7B:
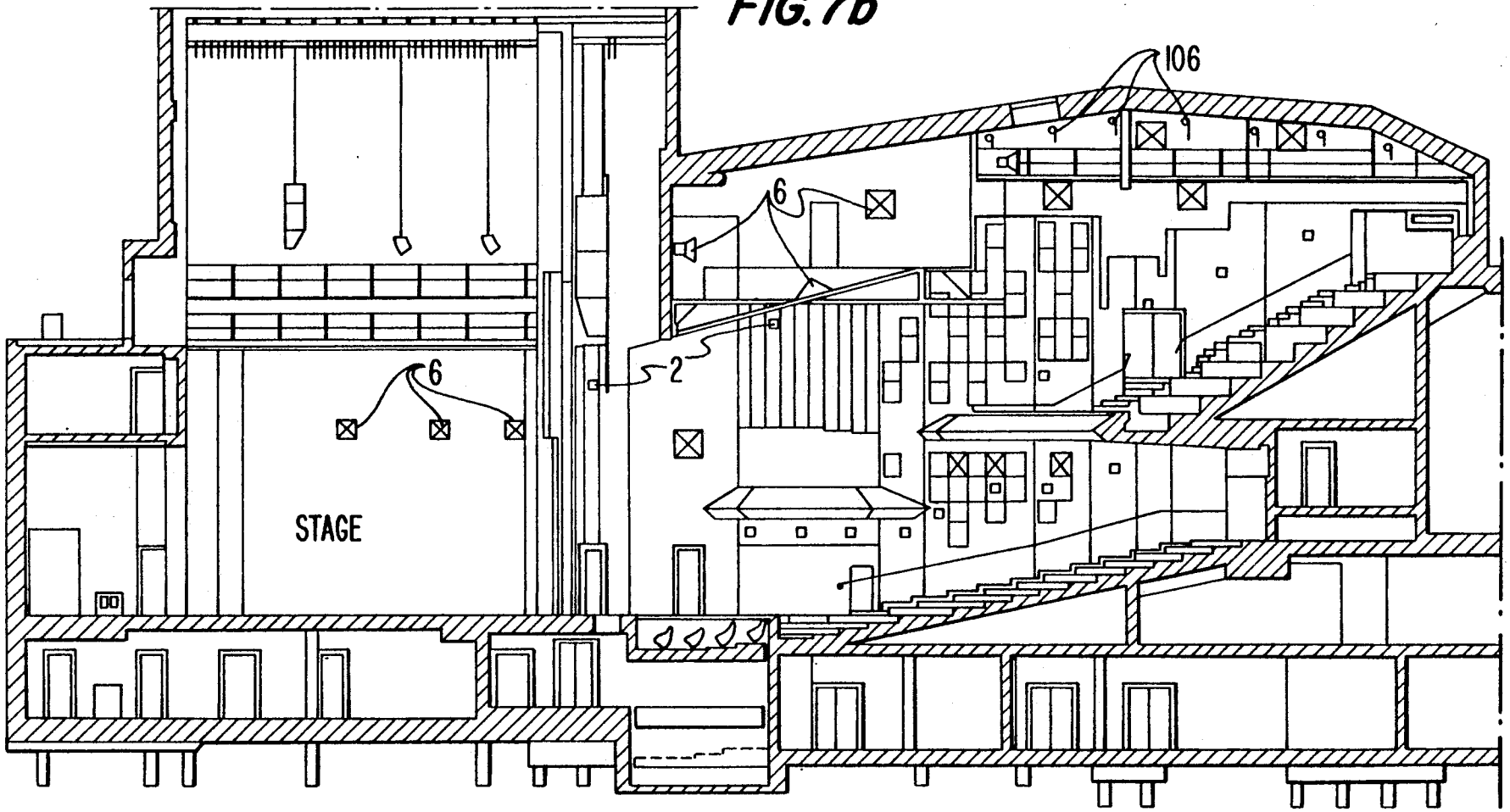
Figure 8A:
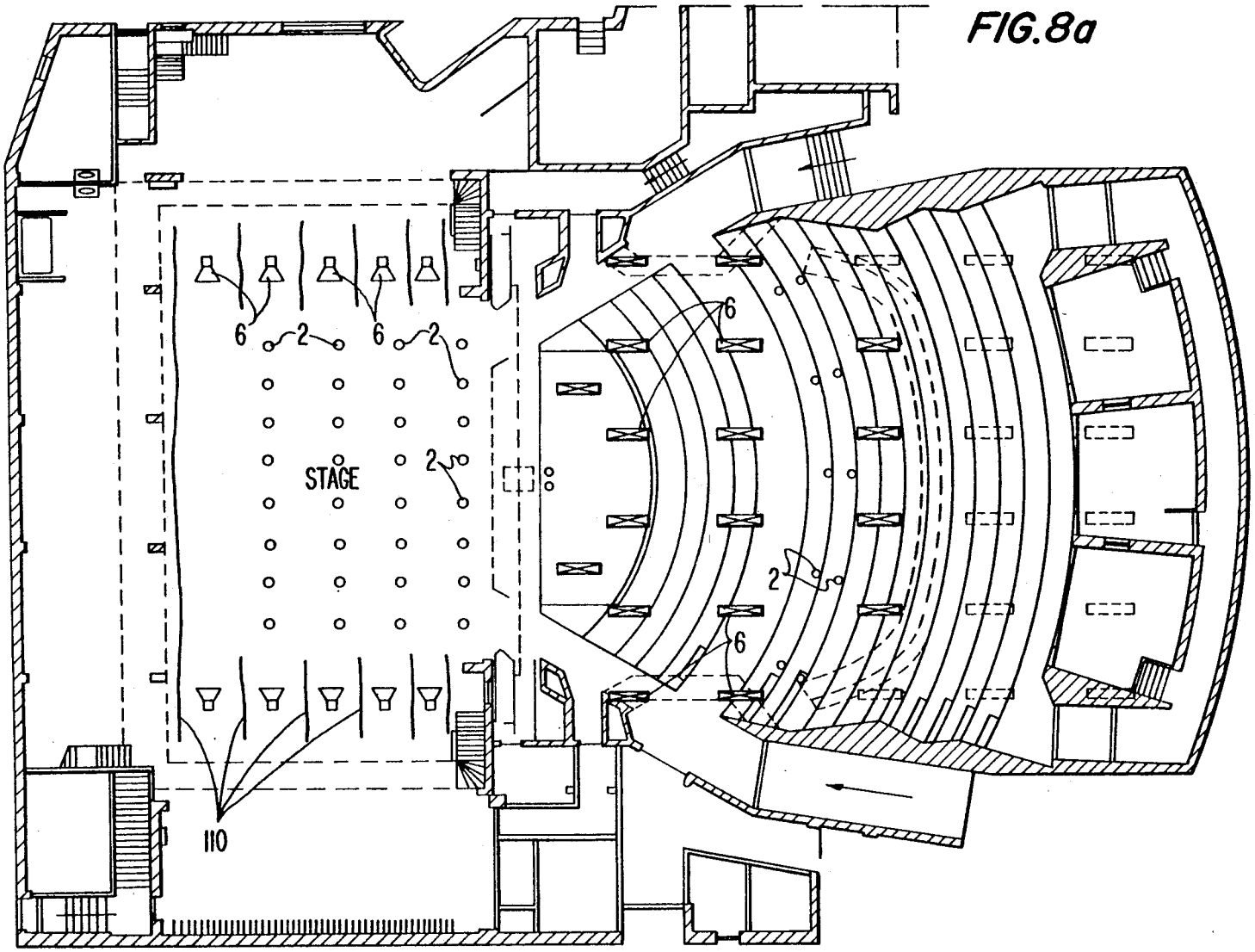
Figure 8B:
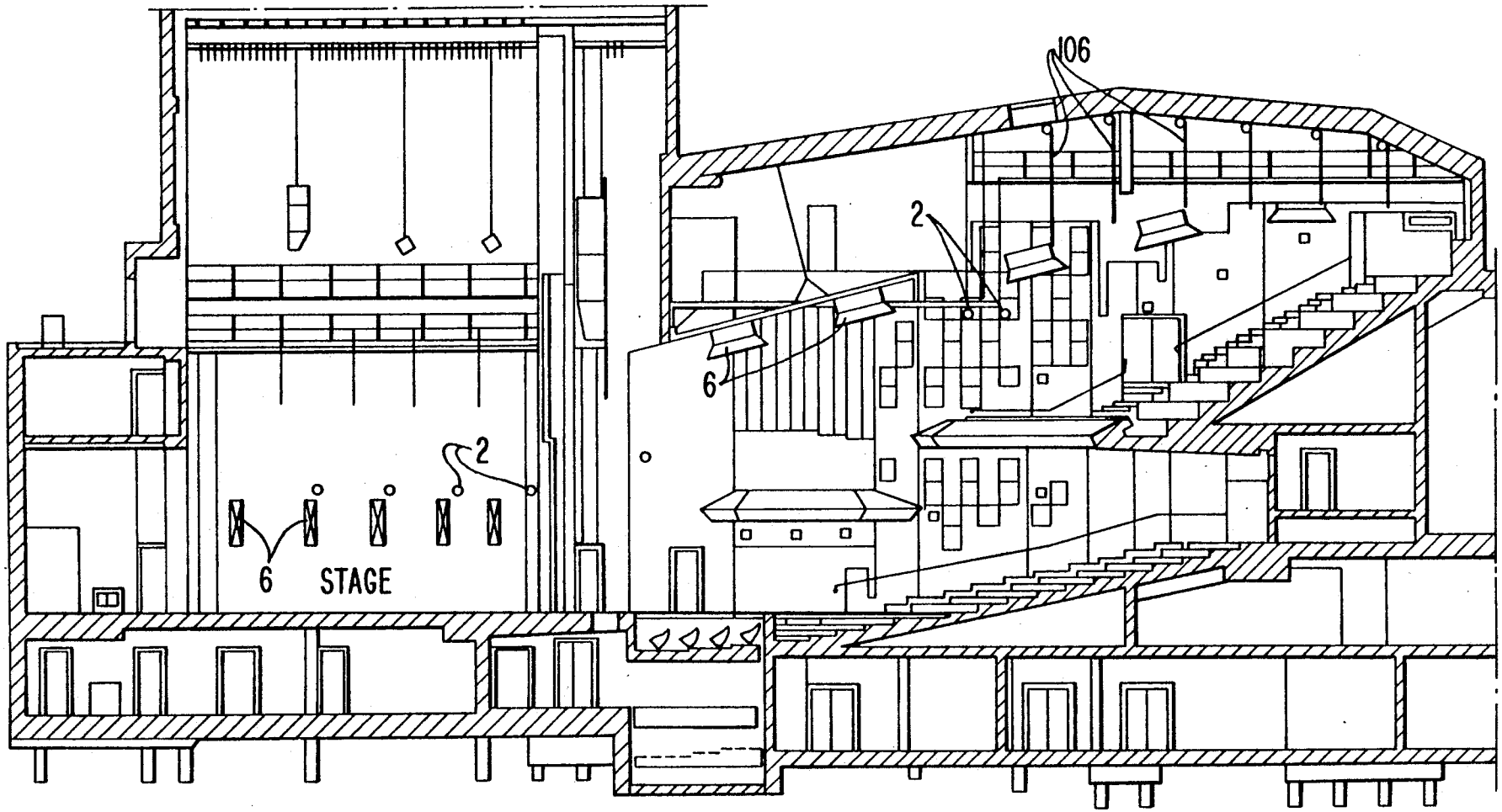

The loudspeakers 6 are placed at a short distance from the audience and/or the stage and they are individually adjusted to a level at which no localization effect occurs, which especially applies to auditoriums with locations having a small reverberant field by nature, that is, a small volume or a relatively deep space in and under the balconies in relation to the height at that location, which means a bad coupling with the reverberant field of the auditorium. Also in this situation, a reverberant field is generated by bringing the sound to the listeners as much as possible via reflection from acoustically hard surfaces. See FIG. 6 showing loudspeakers 6 under balcony 60.

The number of loudspeakers 6 is mostly ten to forty and may amount to about 100, in particular for the situation just described. The object of the arrangement of the loudspeakers 6 is to render, together with the reverberation of the auditorium itself, a naturally sounding reverberation in the auditorium and on the stage. In order to do so the loudspeakers will beam sound in the direction of the reflecting surfaces, with the object of bringing the sound to the listeners in particular by means of reflection and diffusion.

As already said before the result to be attained with the SIAP-system is an acoustic which is built up of the acoustic properties of the auditorium together with the added acoustic signals electro-acoustically generated by the SIAP-system. The most important acoustic properties to be aimed at with the various settings are illustrated, for the auditorium system and the SIAP-system together, in table A.

TABLE A

| | Target values acoustic properties | | | |
|---|---|---|---|---|
| Setting | Reverberation time (s) | Running reverberation (s) | Direction First Reflection | Initial-Time-Delay-Gap (ms) |
| speech | 0.8–1.2 | 0.6–1.2 | frontal | <20 |
| cabaret, revue | 1.0–1.3 | 0.8–1.3 | frontal | 10–20 |
| chamber music | 1.2–1.5 | 1.1–1.5 | lateral | 10–30 |
| operetta, musical | 1.2–1.4 | 1.0–1.4 | lateral | 10–30 |
| opera, ballet | 1.4–1.7 | 1.2–1.7 | lateral | 15–35 |
| symphonic music | 1.7–2.3 | 1.5–2.3 | lateral | 15–40 |
| choir, organ | 2.3–3.5 | 2.0–3.5 | lateral | 20–50 |

The values in table A are target values generally used in acoustics. Dependent on the room to be improved it is also possible to select divergent values in certain cases.

In order to realize the desired acoustic with the SIAP-system and the auditorium the following parameters are measured in an existing auditorium. The reverberation time (T60) dependent on the frequency, the running reverberation (EDT or T10 dependent on the frequency), the delay time of the first reflection and the direction from which it comes, by means of directional microphones and the direction-dependent reflection pattern (reflectogram) and the speech intelligibility according to the so-called RASTI-method (Rapid Speech Transmission Index Method).

By means of a subsystem in the auditorium the oscillation limit of various arrays of microphones 2 and loudspeakers 6 is determined, such as directed picking up of sound and reproduction by means of reflections, picking up of sound with reflections and picking up of sound and reproduction directed at the listeners and picking up of sound with reflections and reproduction with reflections, directed picking up of sound and reproduction directed at the listeners.

By means of the properties of the auditorium known from measurements and/or computations it is determined what additions are desired, such as a first strong lateral reflection, lateral reflections in the time interval between the first reflection and the beginning of the reverberation tail, the initial loudness of the reverberation, reverberation time and frequency dependence of the signal to be added.

With these starting points the system is designed for the auditorium. The number and the composition of the subsystems, the locations of the microphones and the loudspeakers are in principle determined at this stage.

After the SIAP-system has been installed in the auditorium the definitive tuning can take place. For each subsystem the following operations take place: Determining the oscillation limit, equalization of the frequency characteristic for improving the quality of reproduction, in particular in order to prevent coloring, and minimizing the oscillation and possibly adjusting the location and the direction of microphones 2 and loudspeakers 5, programming the acoustic parameters in the processor or processors 4, controlling the amplification and measuring the contribution of the subsystem towards the acoustic of the auditorium.

After the subsystems have been tuned the complete SIAP-system is tuned. This means that alterations are still possible for each subsystem, because the total result must reach a target value. This part is completed by measurements.

When there is a possibility the system will be further tested with live music. The settings can be adapted to the wishes of the users, within the limits of the formulated acoustic criterions for each individual use. By organizing one or more trial concerts the fine adjustment of the system in the situation for which it is intended, namely in the auditorium with an audience present, can take place. During this test measurements can be carried out in order to record the result attained.

The SIAP-system can be used in auditoriums, studios, churches and the like, in brief in all rooms where the acoustic for music leaves something to be desired because of a lack of reverberation and/or reflections, in particular lateral reflections in the entire audible frequency spectrum or a part thereof. Application of the system is also possible in rooms where the reverberation time is too short for speech.

In auditoriums where the reverberation is too short, even for speech, said reverberation can be extended to the desired value. The object of this is to interconnect the individual syllables and words by means of reverberation; on the one hand for the benefit of the melodic lines in speech and on the other hand in order to make sound from the auditorium better audible to the speaker by means of the reverberation (conditions for actors to hear themselves and each other, for example).

Examples are auditoriums with too little reverberation and/or lateral reflection for music, but with a good speech intelligibility, such as theatre and conference auditoriums which are also used for lyric theatre and concerts, auditoriums, such as concert halls, which require acoustic improvement on some points, concert halls with a good acoustic for certain kinds of music, but with shortcomings for other kinds of music, churches having too short reverberation and/or an insufficient spatial acoustic for choir and organ music, rooms in which the reverberation cannot be extended by architectural means or by a reverberation system based on acoustic feedback, such as the MCR-system, because in that case the loudness becomes too great, auditoriums where multifunctionality is of primary concern and an electro-acoustic system can offer a solution to measure because of its multitude of possible settings in combination with a quick and simple operation, auditoriums where the acoustic coupling between the stage area and the audience area is not optimal, such as a stage house having a great deal of reverberation and an auditorium having little reverberation or vice versa, auditoriums, studios and the like where for each individual piece of music a different adjustment may be desirable.

The two examples which are given hereinafter describe the testing in the two theatre auditoriums during concerts, using a system having a limited extent.

EXAMPLE I

A concert with an audience present in the Stadsschouwburg Casino at 's-Hertogenbosch, the Netherlands. There were used four condenser microphones having a cardiod polar pattern, at about 6 m above the stage, four sound field processors, four power amplifiers (100 W RMS) and four loudspeakers on the bridge above the large sound reflector and directed at the ceiling and the side walls. Table B below indicates the reverberation time measured. One subsystem was used.

TABLE B

| | Measured reverberation time (s) Center frequency octave band (Hz) | | | | | | |
|---|---|---|---|---|---|---|---|
| | 125 | 250 | 500 | 1000 | 2000 | 4000 | 500/1000 (means value) |
| No audience[1] without SIAP-system | | | | | | | |
| stalls | 2.02 | 1.88 | 1.11 | 1.22 | 1.08 | 0.97 | 1.17 |
| balcony | 1.83 | 1.78 | 1.36 | 1.24 | 1.10 | 0.97 | 1.30 |
| with SIAP system | | | | | | | |
| stalls | 2.79 | 2.40 | 1.64 | 1.76 | 1.65 | 1.22 | 1.71 |
| balcony | 2.09 | 2.11 | 1.85 | 1.96 | 1.89 | 1.27 | 1.90 |
| Extension of reverberation by SIAP-system | | | | | | | |
| stalls | 0.77 | 0.52 | 0.53 | 0.54 | 0.57 | 0.25 | 0.54 |
| balcony | 0.26 | 0.33 | 0.49 | 0.72 | 0.79 | 0.30 | 0.60 |
| Audience present[2] with SIAP-system | | | | | | | |
| stalls | 2.35 | 1.98 | 1.98 | 1.66 | 1.44 | 1.18 | 1.82 |
| balcony | 2.44 | 1.94 | 2.21 | 1.83 | 1.62 | 1.27 | 2.02 |

[1]with pink noise as a sound signal
[2]with a choir (about 100 persons), a symphony orchestra and 800 attendants (full house)
with the final chords of the music as a sound source
N.B. - the average of the values for the octave bands of 500 and 1000 Hz is normally used as an evaluation criterion
the sound field processors were set at 1.8 s, with a target of 1.7-1.8 s, to be attained at 500/1000 Hz
the input signal was processed in the frequency range of 50–4000 Hz.

EXAMPLE II

A concert with an attendance in Social Cultureel Centrum De Lievekamp at Oss, The Netherlands. There were used two condenser microphones at the side of the stage, having a cardiod polar pattern in the centre of the travelling bridge, at a height of about 7 m above the stage, four sound field processors, four power amplifiers (100 W RMS) and four loudspeakers. Two subsystems were used. The sound was reproduced in the attic above the auditorium and entered the auditorium again via the openings in the ceiling of mainly the lighting gallery. The reverberation time measured is illustrated in table C.

TABLE C

| | Measured reverberation time (s) Center frequency octave band (Hz) | | | | | | |
|---|---|---|---|---|---|---|---|
| | 125 | 250 | 500 | 1000 | 2000 | 4000 | 500/1000 (mean value) |
| Audience present[1] without SIAP-system | | | | | | | |
| stalls | 1.61 | 1.13 | 0.85 | 0.82 | 0.88 | 0.76 | 0.83 |
| balcony | —[2] | 1.07 | 1.11 | 0.84 | 0.86 | 0.76 | 0.98 |
| with SIAP-system | | | | | | | |
| stalls | 2.50 | 2.12 | 1.79 | 1.80 | 1.39 | 0.77 | 1.80 |
| balcony | —[2] | 1.58 | 1.69 | 1.68 | 1.37 | 0.78 | 1.68 |
| Extension of reverberation by SIAP-system | | | | | | | |
| stalls | 0.89 | 0.99 | 0.94 | 0.98 | 0.51 | 0.01 | 0.97 |
| balcony | —[2] | 0.51 | 0.58 | 0.84 | 0.51 | 0.02 | 0.70 |

[1]with symphony orchestra and 400 attendants
with pink noise as a sound signal
the sound field processors were set at 1.8 s for middle frequencies; the input signal was processed in the frequency range of 100-2500 Hz
[2]measurement not reliable (signal to noise ratio).

The two examples have shown that the reverberation time set in the SIAP-system is reached, that longer values than those which have been set in the sound field processors may occur as a result of the contribution of a natural reverberation of the auditorium itself, that long reverberation times of for example 3 s and more are possible in practice and that, because use is made of the reverberation of the auditorium itself, the reverberation time is dependent, just as with a natural reverberation, on the seat occupancy of the auditorium (the audience).

It is in particular important to determine that not only an extension of the reverberation time is achieved, but that also the reverberation, together with the reverberation of the auditorium itself, sounds very naturally and that the spaciousness of the sound is increased because of the increase of lateral reflections and the fact that the reverberation is perceived around the audience.

During the tuning of the system, prior to the concert, the influence of the use of reflections with picking up and reproduction has been tested with both examples. Test signals such as noise, an alarm pistol, and music recorded in an anechoic room and reproduced by loudspeakers on the stage (artificial orchestra) served as sound sources. With example I it was moreover possible to experiment during a few rehearsals of the orchestra. Situations have been tested with the microphones 2 directed for picking up direct sound with as few reflections as possible, in combination with loudspeakers 6 directed at the listeners, the microphones 2 directed for picking up direct sound with as few reflections as possible, in combination with loudspeakers 6 directed at the walls and the ceiling and with the microphones 2 directed for picking up sound with reflections and loudspeakers 6 directed at the walls and the ceiling.

These experiments have shown that the natural quality of the reverberation is audibly improved by enlarging the distance between the microphones 2 and the sound source, as a result of which the reflection density in the output signals of the processors 4 becomes greater, because the input signals of the processors 4 contain more reflections in that case, the natural quality of the reverberation and the spaciousness of the sound are audibly improved because the sound from the loudspeakers 6 is brought to the audience via reflection, whereby only in this way it can be attained that the auditorium "sings along" and the best result is achieved by a combination of microphones 2 directed for receiving direct sound and reflected sound and the loudspeakers 6 directed at reflecting surfaces, and also that it is easy to hear where the loudspeakers 6 are (localization) in case they are directed at the audience.

The most important features of the SIAP-system are that preferably sound reflections are picked up by the microphones 2, that the loudspeakers 6 are preferably directed at reflecting surfaces in order to generate lateral reflections of the desired number and intensity, that the acoustic parameters in the processor 4 are adjustable, that the oscillation limits of individual channels or subsystems are independent of one another, that the reverberation time set in the processors 4 may be shorter or longer than the value measured in the auditorium, that use is made of reflections between loudspeakers 6 and listeners, that the reverberation time is dependent on the occupancy of the auditorium, that the extent of the system is also determined by the size of the auditorium and that the extent of the system is also determined by the desired degree of acoustic improvement.

By way of illustration of the differences between the SIAP-system, the ACS-system and the MCR-system the location of microphones and loudspeakers is illustrated in FIGS. *7a, b*; *8a, b* and *9a, b* respectively, in plan view (a) and in section (b), using as an example the main auditorium of the Stadsschouwburg Casino at 's-Hertogenbosch, The Netherlands (example I).

In FIGS. *7a, b* (SIAP-system) ten pairs of microphones 2 are placed above the front part of the stage at location 100 and ten pairs of microphones are placed above the stage opening at location 102 for the benefit of the auditorium, six pairs of microphones 2 are placed above the front part of the stage and six pairs of microphones 2 are place above the stage opening for the benefit of the stage, there is an orchestra shell wall 104 for the benefit of reflections in the stage area, 26 loudspeakers 6 are directed at reflecting surfaces in the auditorium (i.a. above a sound reflector, at the location of walls and directed at opposite reflecting surfaces), six loudspeakers 6 are placed in the side walls of the orchestra shell on the stage, ten subsystems are provided for the auditorium and six for the stage, and use is made of the space above the balcony intended for the development of reverberation by drawing up the curtains 106 of the device for a variable acoustic, which is normally done for the concert situation (reverberation time 1.1 s).

In FIG. *8a, b* (ACS-system) the auditorium reverberation module comprises a large number of microphones 2 (32 and two for the soloist) placed low above the stage, one processor is provided for the auditorium and one for the stage, the stage is surrounded by the stage curtains 110 in order to prevent reflections, the loudspeakers are directed at the audience, the curtains 106 for a variable acoustic are lowered in order to prevent reflections and reverberation produced by the auditorium itself, which is normally done for the stage situation (reverberation time 0.8 s) and ten microphones are provided in the auditorium and ten loudspeakers are provided on the stage for the benefit of reflections on the stage.

Figure 9A:
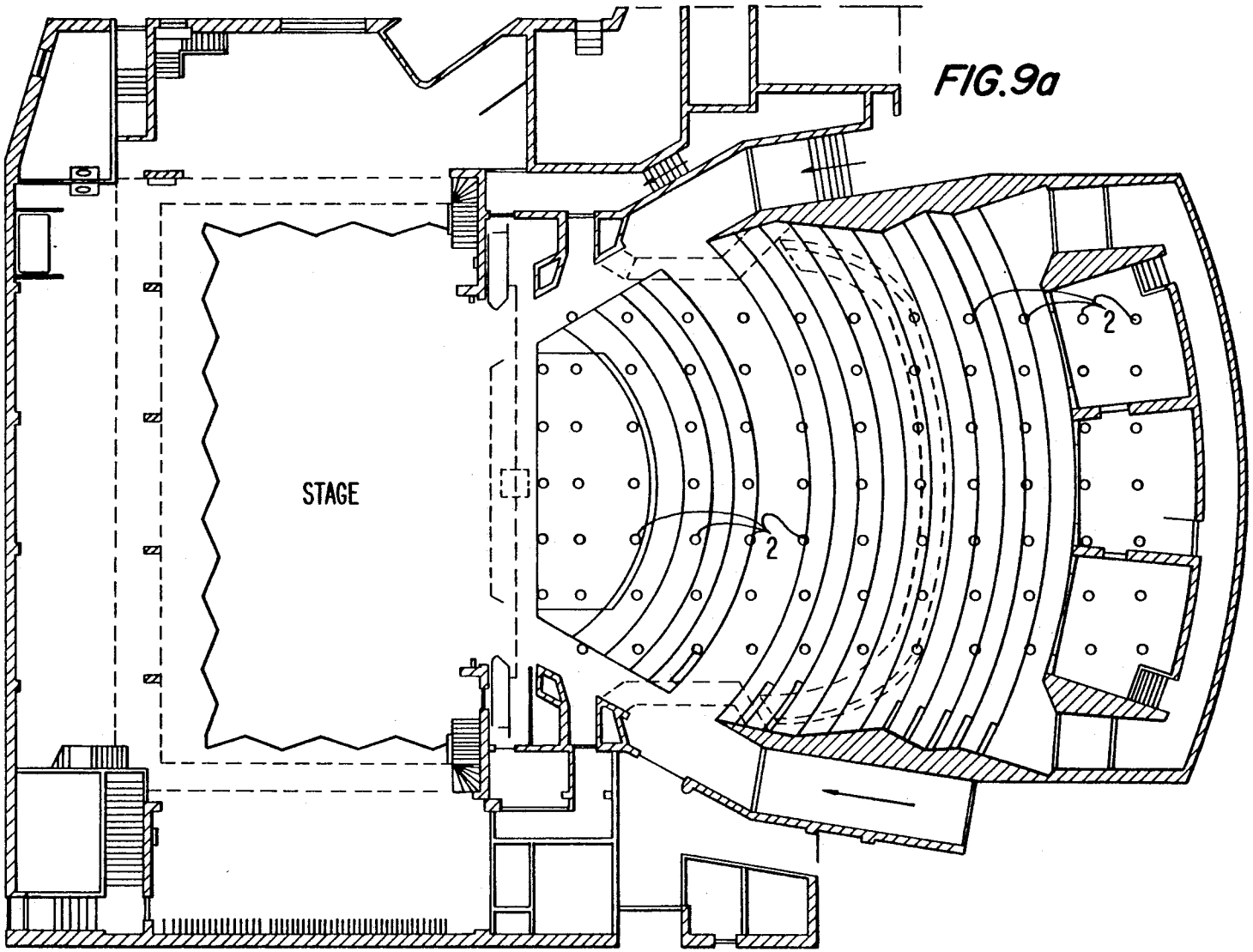
Figure 9B:
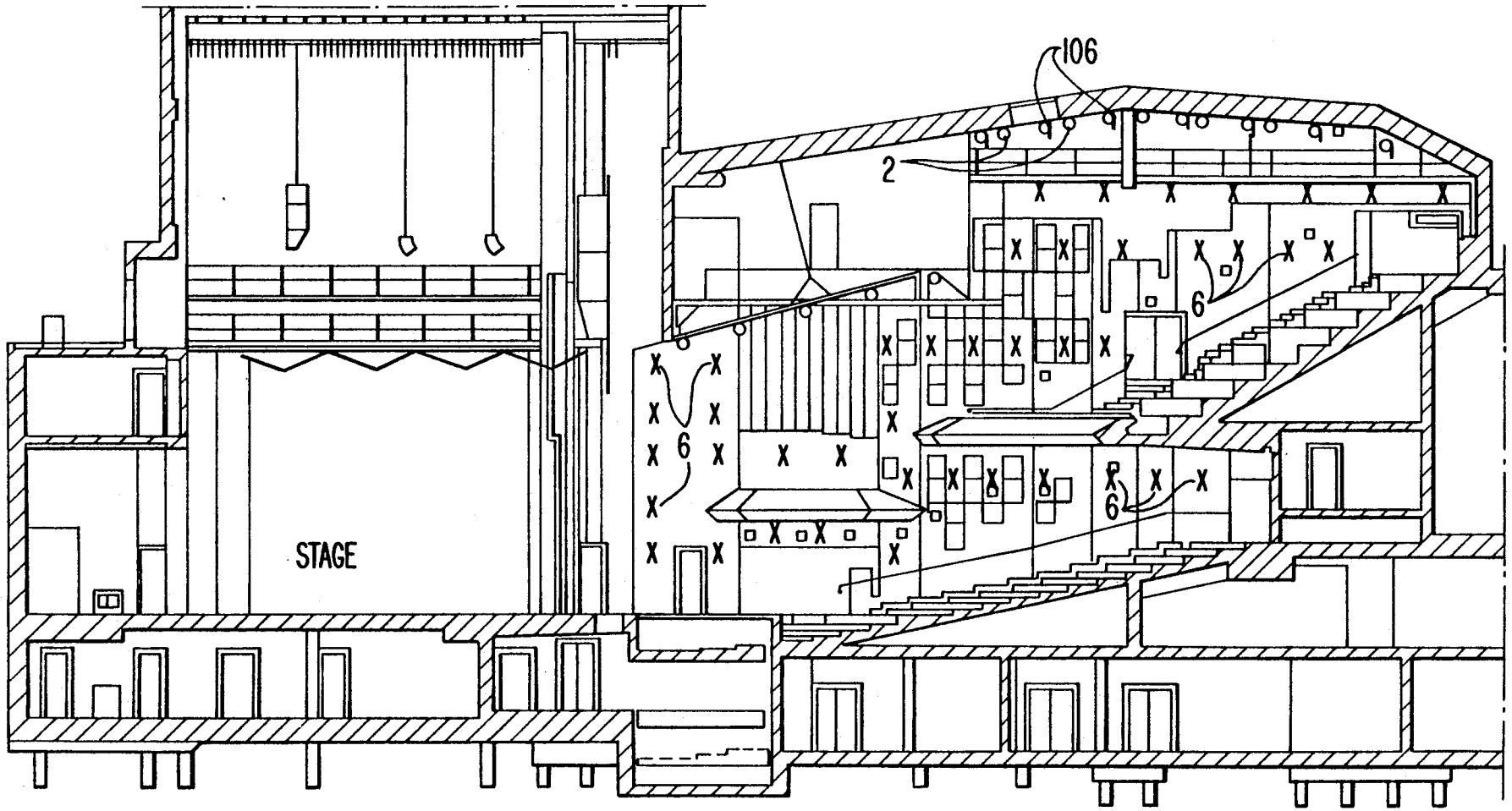

In FIG. 9*a*, *b* (MCR-system) large numbers of microphones and loudspeakers (82 of each) are placed in the reverberant field.

I claim:

1. Electro-acoustic system for improving the acoustic of a predetermined room having a sound source and means for reflecting sound emanating from the sound source, said system comprising a microphone array having a plurality of microphones and a loudspeaker array having a plurality of loudspeakers, said microphone array and said loudspeaker array being disposed in the room, and a signal processing unit operatively interposed between said arrays, said signal processing unit having means for generating reflections, wherein at least one of the microphones is directed in such a manner that it receives at least sound reflected from the sound source by said reflecting means and at least another of the microphones being directed to receive unreflected sound from the sound source in the predetermined room, wherein the predetermined room comprises an audience area having reflecting surfaces and a diffuse sound field, and a stage area, and wherein at least one of the microphones has a fixed location in the diffuse sound field of the audience area and is directed at the reflecting surfaces in the audience area.

2. Electro-acoustic system according to claim 1, whereby the predetermined room comprises the audience area having a diffuse sound field and the stage area having reflecting surfaces, characterized in that said at least one microphone has a fixed location in the diffuse sound field of the audience area and it is directed at the reflecting surfaces in the stage area.

3. Electro-acoustic system according to claim 1, whereby the predetermined room further comprises the stage area having a diffuse sound field, characterized in that at least one of the microphones has a fixed location in the diffuse sound field of the stage area and is directed at the reflecting surfaces in the audience area.

4. Electro-acoustic system according to claim 1, whereby the predetermined room comprises the stage area having a diffuse sound field and reflecting surfaces characterized in that at least one of the microphones has a fixed location in the diffuse sound field of the stage area and is directed at the reflecting surfaces in the stage area.

5. Electro-acoustic system as in claim 1, wherein at least one of the loudspeakers is directed at said reflecting means.

6. Electro-acoustic system according to claim 1, characterized in that the distance between the microphones and the sound source is in the range of 5–10 m.

7. Electro-acoustic system according to claim 1, characterized in that the number of microphones is 10–40.

8. Electro-acoustic system according to claim 1, whereby the predetermined room comprises the audience area with a reverberant field, characterized in that at least some of the loudspeakers have a fixed location and direction proximate the top of the audience area to augment the reverberant field of the audience area itself whereby a naturally sounding augmented reverberant field can be realized.

9. Electro-acoustic system according to claim 1, whereby the predetermined room comprises the audience area having spaced apart overhead reflecting surfaces, characterized in that the loudspeakers are installed above the overhead reflecting surfaces and directed between said spaced apart reflecting surfaces in such manner that the reflections and reverberation produced by the system, mixed with those of the audience area, can reach the audience area and the stage area.

10. Electro-acoustic system according to claim 1, whereby the predetermined room comprises the audience area having an overhead secondary room and a ceiling with openings separating said secondary room from the rest of the audience area, characterized in that the loudspeakers are installed in the secondary room above the ceiling having openings to the audience area, said loudspeakers being directed through said openings such that the sound reproduced by the loudspeakers is mixed with the reverberation naturally present in the audience area and can reach the audience area and the stage area through said openings in the ceiling.

11. Electro-acoustic system according to claim 1, wherein the predetermined room includes a plurality of reflecting surfaces characterized in that the loudspeakers are installed at short distances from the microphones and the signal processing unit is adapted such that no localization effect occurs, and wherein the loudspeakers are directed at said reflecting surfaces.

12. Electro-acoustic system according to claim 1, characterized in that the number of loudspeakers is 10–40.

13. Electro-acoustic system according to claim 1, characterized in that the number of loudspeakers is in the order of 100.

14. Electro-acoustic system according to claim 1, characterized in that the signal processing unit comprises at least one digital sound field processor and at least one power amplifier connected therewith.

15. Electro-acoustic system for improving the acoustic of a predetermined room having a sound source and means for reflecting sound emanating from the sound source, said system comprising a microphone array having a plurality of microphones and a loudspeaker array having a plurality of loudspeakers, said microphone array and said loudspeaker array being disposed in the room, and a signal processing unit operatively interposed between said arrays, said signal processing unit having means for generating reflections, wherein at least one of the microphones is directed in such a manner that it receives at least sound reflected from the sound source by said reflecting means and at least another of the microphones being directed to receive unreflected sound from the sound source in the predetermined room, wherein said system is built up of a number of separate subsystems each having an oscillation limit, whereby each subsystem comprises at least two microphones, at least one digital sound field processor, at least one power amplifier and at least one loudspeaker, the oscillation limits of said subsystems being independent from one another, and wherein the predetermined room has an audience area and that at least one of the loudspeakers is a "full range" loudspeaker and is positioned in the audience area directed at listeners.

16. Electro-acoustic system according to claim 15, characterized in that the number of subsystems is smaller than or equal to 50.

17. Electro-acoustic system according to claim 16, characterized in that the number of subsystems is 2–40.

18. Electro-acoustic system according to claim 15, characterized in that a fraction of said number of subsystems is provided for the benefit of the audience area and that the remainder of said number of subsystems is provided for the benefit of the stage area.

19. Electro-acoustic system according to claim 15, characterized in that most loudspeakers are "full range", positioned in the audience area, and directed at listeners.

20. Electro-acoustic system according to claim 1, wherein the sound source has a direct sound field, characterized in that at least said another of the microphones is located in the direct sound field of the sound source.

21. Electro-acoustic system according to claim 1, characterized in that there is interposed between said microphones and said signal processing unit at least one frequency spectrum equalizer.

22. Electro-acoustic system according to claim 1, characterized in that the microphones have a cardiod polar pattern.

23. Electro-acoustic system according to claim 1, characterized in that the microphones have a super cardiod polar pattern.

24. Method of setting acoustic parameters of an electro-acoustic system in a predetermined room, the system comprising one or more subsystems each having a microphone array with a plurality of microphones, a loudspeaker array with a plurality of loudspeakers, and a signal processing unit operatively interposed between the microphone array and the loudspeaker array, the signal processing unit for electronically generating reflections and having means for inputting adjustable parameters, and wherein at least one microphone is directed to receive reflected sound from sound reflecting means in the predetermined room and another microphone is directed to receive unreflected sound, characterized in that at least one of the following parameters is measured:

frequency-dependent reverberation time,
frequency-dependent running reverberation,
direction of origin of a first reflection and an Initial-Time-Delay-Gap,
reflection pattern,
direction-dependent reflection pattern, and
speech intelligibility;

that the at least one parameter measured is compared with a target value for the predetermined room ; and that the adjustable input parameters of the signal processing unit are set in accordance with the result of said comparison.

25. Method according to claim 24, wherein each subsystem has an independent oscillation limit, characterized in that the oscillation limit of each subsystem is predetermined.

26. Method according to claim 24, characterized in that the adjustable input parameters of the system comprise at least one of the following:

a first strong lateral reflection,
lateral reflections in the time interval between the first strong lateral reflection and the beginning of a reverberation tail of said first strong lateral reflection,
an initial loudness of the reverberation,
a reverberation time,
frequency dependence of the reverberation, and
frequency dependence of the processed signal, and wherein said adjusting step includes adjusting said at least one adjustable parameter.

27. Method according to claim 26, characterized in that on the basis of the acoustic parameters of the system to be adjusted, the number and the composition of the subsystems and the location of the microphones and the loudspeakers are determined prior to said parameter measuring step.

28. Method according to claim 27, wherein the system comprises a plurality of subsystems, each with a microphone array, a loudspeaker array, and a signal processing unit of the aforementioned type, and wherein the signal processing unit includes a frequency spectrum equalizer, characterized in that, in sequence, the microphones and the loudspeakers are placed in said predetermined room and the oscillation limit is determined for each subsystem, that the frequency characteristic is equalized for the purpose of improving the quality of reproduction, that oscillation is minimized, that the acoustic parameters are set, that the amplification is controlled, and that the contribution of each subsystem towards the acoustic of the room is measured.

29. Method according to claim 28, characterized in that after the subsystems have been tuned the entire system is tuned by adjusting the subsystems, in order that the total acoustic reaches the target value.

* * * * *